US012680321B2

(12) United States Patent
Behrbohm

(10) Patent No.: US 12,680,321 B2
(45) Date of Patent: Jul. 14, 2026

(54) FRAMEWORK SUPPORT

(71) Applicant: WILHELM LAYHER VERWALTUNGS-GMBH, Güglingen-Eibensbach (DE)

(72) Inventor: Wolf C. Behrbohm, Besigheim-Ottmarsheim (DE)

(73) Assignee: WILHELM LAYHER VERWALTUNGS-GMBH, Güglingen-Eibensbach (DE)

( * ) Notice: Subject to any disclaimer, the term of this patent is extended or adjusted under 35 U.S.C. 154(b) by 83 days.

(21) Appl. No.: 18/562,185

(22) PCT Filed: Apr. 12, 2022

(86) PCT No.: PCT/EP2022/059671
§ 371 (c)(1),
(2) Date: Nov. 20, 2023

(87) PCT Pub. No.: WO2022/242964
PCT Pub. Date: Nov. 24, 2022

(65) Prior Publication Data

US 2024/0368904 A1 Nov. 7, 2024

(30) Foreign Application Priority Data

May 18, 2021 (DE) ..... 102021112759.9

(51) Int. Cl.
*E04G 11/50* (2006.01)

(52) U.S. Cl.
CPC ..... *E04G 11/50* (2013.01)

(58) Field of Classification Search
CPC ..... E04G 11/50; E04G 11/48; E04G 11/54; E04C 3/06; E04C 2003/0417;
(Continued)

(56) References Cited

U.S. PATENT DOCUMENTS 2,042,463 A * 6/1936 Henderson ..... E04C 3/08 52/645
7,155,874 B2 * 1/2007 Lee ..... E04C 3/06 52/843

(Continued)

FOREIGN PATENT DOCUMENTS

DE 2065371 A1 10/1973
DE 19705805 A1 1/1998

(Continued)

OTHER PUBLICATIONS

International Search Report for PCT/EP2022/059671, dated Jul. 22, 2022, 14 pages.

*Primary Examiner* — Muhammad Ijaz
(74) *Attorney, Agent, or Firm* — Rankin, Hill & Clark LLP

(57) ABSTRACT

A framework support (10), in particular for a framework, a formwork structure or the like, comprises two U-shaped profile supports (14, 16) which are elongated in a framework support longitudinal direction, each with two profile legs (18, 20, 22, 24) and a profile web (26, 28) connecting the two profile legs (18, 20, 22, 24) to one another, wherein the two profile supports are detachably connected to one another by means of a plurality of connecting elements (54), wherein the profile webs (26, 28) of the profile supports face one another, with interposition of at least one spacer element (50).

22 Claims, 11 Drawing Sheets

(58) Field of Classification Search
CPC ..... E04C 2003/0434; E04C 2003/0439; E04C 2003/0465; E04C 2003/0473
USPC ..... 248/500, 228.1
See application file for complete search history.

(56) References Cited

U.S. PATENT DOCUMENTS

2004/0096129 A1* 5/2004 Schmalzhofer ..... B23Q 1/58 384/42
2005/0109127 A1* 5/2005 Bullivant ..... E04C 3/291 73/862.474
2005/0241258 A1* 11/2005 Shih ..... E04G 11/50 52/647
2005/0252161 A1* 11/2005 Hovey ..... E04B 1/24 52/837
2012/0047834 A1* 3/2012 Stal ..... B21D 47/01 52/356
2015/0322675 A1* 11/2015 Shih ..... E04C 3/00 52/848
2016/0090741 A1* 3/2016 Jobin ..... E04B 1/34326 52/646
2021/0010280 A1* 1/2021 Mikic ..... E04C 3/29
2023/0003023 A1* 1/2023 Zieta ..... E04G 11/045
2023/0392378 A1* 12/2023 Hung ..... E04C 3/07
2024/0288019 A1* 8/2024 Bollman ..... A47B 21/04
2024/0317493 A1* 9/2024 Parks ..... B65G 1/0464
2024/0368904 A1* 11/2024 Behrbohm ..... E04C 3/06
2024/0392567 A1* 11/2024 Felix ..... E04B 1/30
2025/0003207 A1* 1/2025 Donovan ..... E04B 1/2403
2025/0012100 A1* 1/2025 Rogers ..... E04C 3/005
2025/0043573 A1* 2/2025 Pranger ..... B21D 47/01

FOREIGN PATENT DOCUMENTS

DE 20318912 U1 3/2004
DE 102016205605 A1 10/2017
DE 102018103898 A1 8/2019
DE 102018123387 A1 3/2020
EP 2261441 A2 12/2010
EP 3715548 A1 9/2020
GB 2127082 A 4/1984
WO 2009035226 A2 3/2009

* cited by examiner

FRAMEWORK SUPPORT

The present invention relates to a framework support, which can be used to build a framework, in particular a scaffolding, a formwork structure or another support structure.

From DE 197 05 805 A1 a framework support that can be used as a ceiling formwork support is known, which is constructed with two U-shaped profile supports. The two profile supports are positioned facing each other with their profile webs connecting the respective profile legs and are inseparably connected to one another by spacer elements positioned between the profile supports and firmly connected to them by welding, as well as by spacer elements welded to profile support side surfaces formed in the region of the profile legs.

DE 10 2016 205 605 A1 discloses a framework support with two U-shaped profile supports, which are formed integrally with one another by bending a metal sheet into a shape providing the two profile supports and are therefore inseparably connected to one another.

It is the object of the present invention to provide a framework support which is easy to handle while having a simple structure and high versatility in use.

According to the invention, this object is achieved by a framework support, in particular for a framework, a formwork structure or the like, comprising two U-shaped profile supports which are elongated in a framework support longitudinal direction, each with two profile legs and a profile web connecting the two profile legs to one another, wherein the two profile supports are detachably connected to one another by means of a plurality of connecting elements, wherein the profile webs of the profile supports face one another, with interposition of at least one spacer element.

In the framework support constructed according to the invention, the profile supports that provide an essential component of the same are not inseparably connected to one another. The connection of the profile supports is produced by means of connecting elements designed, for example, as screw bolts, with interposition of the spacer elements.

This makes it possible to move the individual components of such a framework support to the location intended for installation and only then to assemble it there to form a larger and therefore significantly heavier framework support. Furthermore, the construction of such a framework support with components that can be detached from one another enables the use of parts that are particularly suitable for the intended purpose in a simple manner.

To connect the profile supports to one another or to other components, it is proposed that in the profile web of each of the profile supports at least one row of first profile support openings following one another in the framework support longitudinal direction for the passage of a connecting element and at least one row of second profile support openings arranged one after the other in the framework support longitudinal direction, orthogonal to the framework support longitudinal direction and arranged at a distance from the at least one row of first profile support openings, are designed for the passage of a connecting element, and that:

- a distance from first profile support openings directly following one another in the framework support longitudinal direction substantially corresponds to a distance from second profile support openings directly following one another in the framework support longitudinal direction, or/and
- a distance between the at least one row of first profile support openings and the at least one row of second profile support openings orthogonal to the framework support longitudinal direction substantially corresponds to the distance from first profile support openings directly following one another in the framework support longitudinal direction and/or the distance from second profile support openings directly following in the framework support longitudinal direction, or/and
- a plurality of successive pairs in the framework support longitudinal direction are each formed with a first profile support opening and a second profile support opening, wherein in each pair of a first profile support opening and a second profile support opening the two profile support openings are substantially not offset relative to one another in the framework support longitudinal direction.

A high degree of variability in the structure can be supported by the fact that a second profile support opening forming a pair with each first profile support opening is provided in association with each first profile support opening.

In order to provide a large surface for the interaction of a framework support according to the invention with other components to be coupled to it or to be supported on it, on which such support can take place, it is proposed that for each of the profile supports a first of the profile legs provides a first profile support side surface and a second of the profile legs provides a second profile support side surface, wherein the first profile support side surfaces of the first profile legs together provide a first framework support surface region and the second profile support side surfaces of the second profile legs together provide a second framework support surface region.

In order to avoid mutual interference with components engaging between the two profile supports of a framework support according to the invention, such as vertical standards of a framework carrying perforated discs, on each of the profile supports in the transition from the first profile support side surface to a profile support end face formed on the profile web and facing the respective other profile support, a chamfer or rounding can be formed, and/or a chamfer or rounding can be formed on each profile support in the transition from the second profile support side surface to the profile support end face.

In order to be able to efficiently use the various profile support openings for a high degree of variability in the construction of a framework support or a support structure constructed therewith, a distance between the first profile support openings positioned closer to the first profile leg and the first profile support side surface can be greater than a distance for each of the profile support between the second profile support openings positioned closer to the second profile leg and the second profile support side surface.

At least one, preferably each, spacer element can be elongated in a spacer element longitudinal direction and have at least two spacer element openings following one another in the spacer element longitudinal direction for the passage of a connecting element.

In adaptation to the opening pattern of the various profile support openings provided in the profile supports, a distance between at least two spacer element openings, preferably directly following one another in the longitudinal direction of the spacer element, can correspond to the distance or an integer multiple of the distance between two first profile support openings, preferably directly following one another in the framework support longitudinal direction, and/or to the distance or an integer multiple of the distance between two second profile support openings, preferably directly following one another in the framework support longitudinal direction.

In order to avoid that the spacer element protrudes beyond the profile supports, regardless of the orientation with which a spacer element is integrated between two profile supports, it is proposed that at least one, preferably each spacer element has spacer element end faces that are spaced apart from one another in the spacer element longitudinal direction, and that for at least one, preferably each, spacer element end face, a distance between a spacer element opening, preferably directly adjacent to the spacer element end face, and the spacer element end face in the direction of the spacer element longitudinal direction is less than or equal to the distance between the second profile support openings and the second profile support side surface of each of the profile supports, or/and that at least one, preferably each spacer element has spacer element side surfaces that are spaced apart from one another orthogonally to the longitudinal direction of the spacer element, for example substantially parallel to one another, and that for each of the profile supports, a distance between the spacer openings following one another in the spacer longitudinal direction and the spacer side surface in at least one, preferably each spacer side surface, substantially corresponds to the distance between the second profile support openings and the second profile support side surface.

An easy-to-handle structure of a framework support can also be facilitated in that at least one, preferably each profile support is made with aluminum material, preferably by extrusion, and/or in that at least one, preferably each spacer element is made with aluminum material, preferably by extrusion.

The invention further relates to a framework support system, comprising at least one framework support constructed according to the invention and at least one insertion element elongated in an insertion element longitudinal direction and/or at least one framework support supporting element and/or at least one framework support connecting element elongated in a connecting element longitudinal direction.

In order to be able to couple an insertion element to the profile supports using the profile support openings formed in the profile supports of a framework support, it is proposed that at least one row of insertion element openings following one another in the insertion element longitudinal direction is provided in the at least one insertion element for the passage of a connecting element, wherein the distance between at least two first profile support openings, preferably directly following one another in the framework support longitudinal direction, and/or the distance between at least two second profile support openings, preferably directly following one another in the framework support longitudinal direction, substantially corresponds to the distance or an integer multiple of the distance between at least two insertion element openings, preferably directly following one another in the insertion element longitudinal direction.

A further increased variability in the structure can be achieved in that at least two rows of insertion element openings following one another in the insertion element longitudinal direction are provided in the at least one insertion element, wherein a distance between directly adjacent insertion element openings in each row of insertion element openings is smaller than a distance between directly adjacent insertion element openings of different rows of insertion element openings.

An insertion element can be easily integrated into a framework support in different installation positions if the at least one insertion element has insertion element side surfaces that are spaced apart from one another orthogonally to the insertion element longitudinal direction, for example substantially parallel to one another, and if at least one, preferably each row of insertion element openings following each other in the longitudinal direction of the insertion element are substantially at the same distance from each insertion element side surface.

In order to be able to couple further components to such an insertion element in a support structure, it can be provided that at least one insertion element has a substantially rectangular cross-sectional profile with narrow sides that are opposite one another, for example substantially parallel to one another, and broad sides that are opposite one another, for example substantially parallel to one another, and that an undercut profile that is open to the outside is provided on at least one narrow side. Furthermore, an easy-to-handle structure can be facilitated by producing at least one insertion element with aluminum material, preferably by extrusion.

To provide a support interaction between a framework support and a framework support supporting element, at least one framework support supporting element can comprise a support head with a framework support supporting surface and a connecting web protruding from the framework support supporting surface and to be positioned between the two profile supports of a framework support with at least one connecting web opening for the passage of a connecting element. Furthermore, to adapt the positioning of a framework support, at least one framework support supporting element can comprise a spindle arrangement.

In order to be able to stably couple a framework support supporting element to the framework support using the profile support openings formed in the profile supports of a framework support, a distance between the at least one connecting web opening and the framework support supporting surface can substantially correspond to the distance between the first profile support openings and the first profile support side surface in each of the profile supports or to the distance of the second profile support openings to the second profile support side surface for each profile support.

In order to be able to easily couple one or different framework supports with support structure elements arranged at different distances from one another, it is proposed that at least one first connecting web opening and at least one second connecting web opening are provided in the connecting web, wherein a distance between the at least one first connecting web opening to a framework support supporting element longitudinal axis is smaller than a distance of the at least one second connecting web opening to the framework support supporting element longitudinal axis.

The construction of a support structure can be facilitated if two first connecting web openings are provided in the connecting web opposite one another with respect to the framework support supporting element longitudinal axis, and/or if two second connecting web openings are provided in the connecting web opposite one another with respect to the framework support supporting element longitudinal axis. The support head of a framework support supporting element constructed in this way can thus be used in two positions rotated by 180° relative to one another, each using the same type of connecting web openings.

For each profile support, a distance between the first profile support side surface and the second profile support side surface can be substantially the sum of a width of at least one spacer element between two spacer element side surfaces lying orthogonally to a spacer longitudinal direction at a distance from one another, for example substantially parallel to one another, spacer element side surfaces and correspond to a width of at least one insertion element between two insertion element side surfaces lying at a distance from one another orthogonally to an insertion element longitudinal direction, for example substantially parallel to one another. In this way, it can be avoided that during the assembly, regions protruding beyond the profile support side surfaces, for example of a spacer element and an insertion element, are not present.

The invention further relates to a support structure, such as a framework or a formwork structure, comprising at least one framework support constructed according to the invention and/or at least one framework support system according to the invention.

To avoid a structure that bends strongly even under higher loads, it is proposed that at least one insertion element and/or at least one framework support connecting element in at least one of its longitudinal end regions, preferably in its two longitudinal end regions, is connected to a framework support by means of at least two connecting elements positioned at a distance from one another in the framework support longitudinal direction. If the possibility is to be created of being able to arrange an insertion element in different angular positions with respect to a framework support, it is advantageous if at least one insertion element is connected to a framework support in at least one of its longitudinal end regions, preferably in its two longitudinal end regions, by means of a single connecting element, so that this insertion element can be pivoted about the connecting element with respect to the framework support.

A high variability in the structure that is easy to implement can be achieved in that two support structure elements, each to be coupled to a framework support or different framework supports by means of a framework support supporting element associated with them, have a support structure element distance from a plurality of predetermined support structure element distances from one another, and that support structure element distances of the plurality of support structure element distances, the distance of the at least one first connecting web opening to the framework support supporting element longitudinal axis, the distance of the at least one second connecting web opening to the framework support supporting element longitudinal axis and the distance of the profile support openings provided for coupling to the framework support supporting elements associated with the two support structure elements, directly following one another in the framework support longitudinal direction, of first profile support openings and second profile support openings of the framework support or the different framework supports meet the following conditions:

$$A:\ D_{T1} = n_1 \times D_2 + 2 \times D_{16}$$

$$B:\ D_{T2} = n_2 \times D_2 - 2 \times D_{17}$$

$$C:\ D_{T3} = n_3 \times D_2 + D_{16} + D_{17}$$

wherein:

$D_{T1}$, $D_{T2}$, $D_{T3}$ are support structure element distances from the plurality of support frame distances ($D_{Ti}$), $n_1$, $n_2$, $n_3$ are integers, $D_2$ is the distance between the profile support openings directly following one another in the framework support longitudinal direction ($L_G$) of the profile support openings provided for coupling with the framework support supporting elements (112) associated with the two support structure elements from the first profile support openings (46) and second profile support openings (48) of the framework support (10) or the various framework supports (10), $D_{16}$ is the distance of the at least one first connecting web opening (120) to the framework support supporting element longitudinal axis ($L_S$), $D_{17}$ is the distance of the at least one second connecting web opening (121) to the framework support supporting element longitudinal axis ($L_S$).

If the conditions A, B, C are met, it is possible to realize more than two different support structure element distances on one or different support structures using only two different types of connecting web openings, which differ in their respective distance from the framework support supporting element longitudinal axis.

The present invention is described in detail below with reference to the attached figures. In particular:

Figure 1:
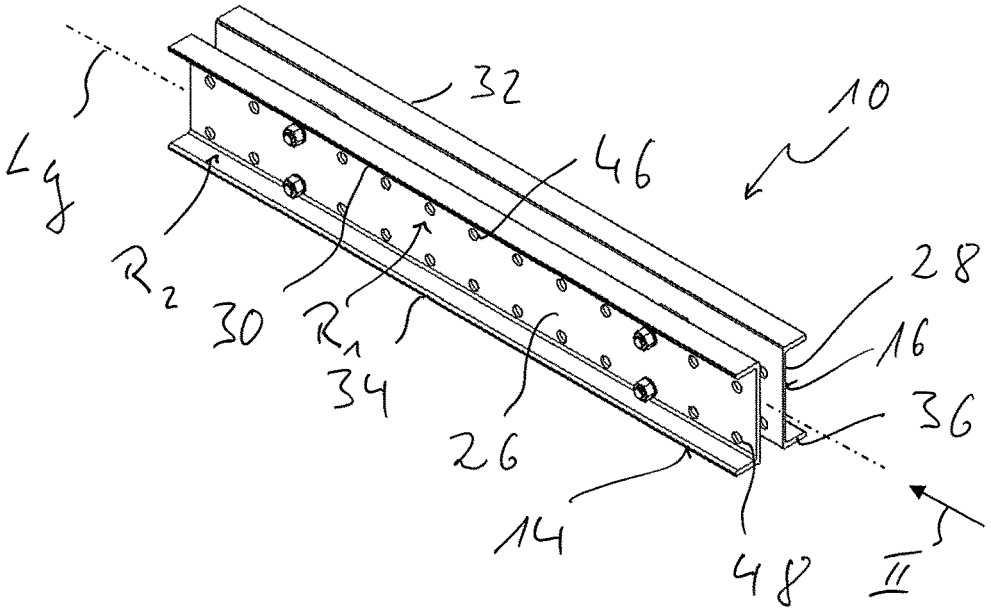
FIG. 1 is a perspective view of a framework support.
Figure 2:
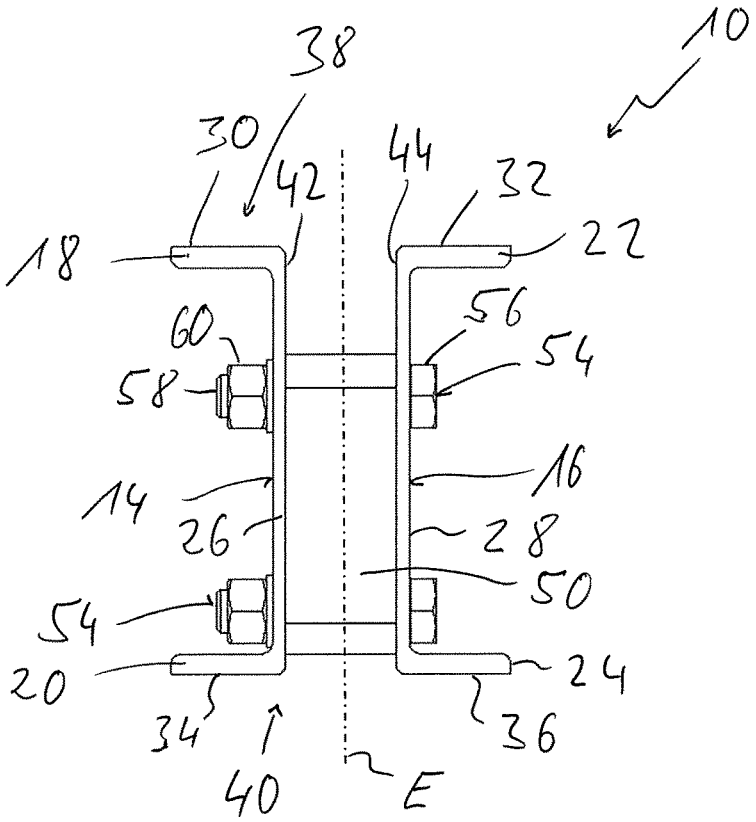
FIG. 2 is a front view of the framework support of FIG. 1 in viewing direction II in FIG. 1.

Before the structure of a framework support, a framework support system and of a support structure constructed with one or more such framework supports or framework support systems is described in detail below with reference to FIGS. 1-15, it is pointed out that in the sense of the present invention and in particular for describing of the invention with reference to FIGS. 1-15, the statement that an opening has a distance from a reference element, for example a side surface or another opening, is to be understood as meaning the distance from the center of the opening of an opening under consideration, for example the center of a circular opening, to the reference element, for example a side surface or the opening center of a further opening. In the case of an elongated hole-like opening, such an opening center can be defined by the intersection of a longitudinal center axis and a transverse center axis. Likewise, within the meaning of the present invention, the statement that a support structure element, which is generally a component elongated in the direction of the support structure element's longitudinal axis, such as a vertical support, is at a distance from a reference element, for example another support structure element is to be understood in the sense that this is the distance of a respective longitudinal axis of a support structure element to the reference element, thus for example the longitudinal axis of another support structure element. Furthermore, the distance to a reference element defined with an axis or a direction refers to the orthogonal, i.e. the shortest distance to the reference element, i.e. the axis or the direction.

FIGS. 1 to 5 show a framework support 10 or individual parts of such a framework support 10 or individual parts of such a framework support 10, which can be used, for example, to build a framework, a formwork structure or another support structure. The framework support 10 comprises two U-shaped profile supports 14, 16 which are constructed substantially identically, each with two profile legs 18, 20 or 22, 24 and a profile web 26, 28 connecting the two profile legs to one another. The two profile legs 18, 20 and 22, 24 are arranged substantially at right angles with respect to the respectively associated profile web 26, 28. A respective first profile leg 18, 22 of the profile supports 14, 16 provides a first profile support side surface 30, 32 on its side facing away from the respective second profile leg 20, 24. Likewise, each second profile leg 20, 24, on its side facing away from the respective first profile leg 18, 22, provides a second profile support side surface 34, 36 that is parallel to the respectively associated first profile support side surface 30, 32. The two first profile support side surfaces 30, 32, which lie next to one another or at the same level and continue each other substantially without an angle, provide a first framework support supporting surface region 38 which is substantially orthogonal to a center plane or plane of symmetry E. Likewise, the two second profile support side surfaces 34, 36, which lie next to one another or at the same level and continue each other substantially without an angle, provide a second framework support side surface region 40 which is substantially orthogonal to the plane of symmetry E. With these framework support side surface regions 38, 40, the framework support 10 in a support structure can rest on or support other system regions or components of a support structure.

In the region of each profile web 26, 28, each profile support 14, 16 has a profile support end face 42, 44. In the assembled state of a framework support 10, the two profile supports 14, 16 are positioned so that their profile support end faces 42, 44 face each other and form an overall structure that is substantially mirror-symmetrical with respect to the plane of symmetry E.

Figure 3:
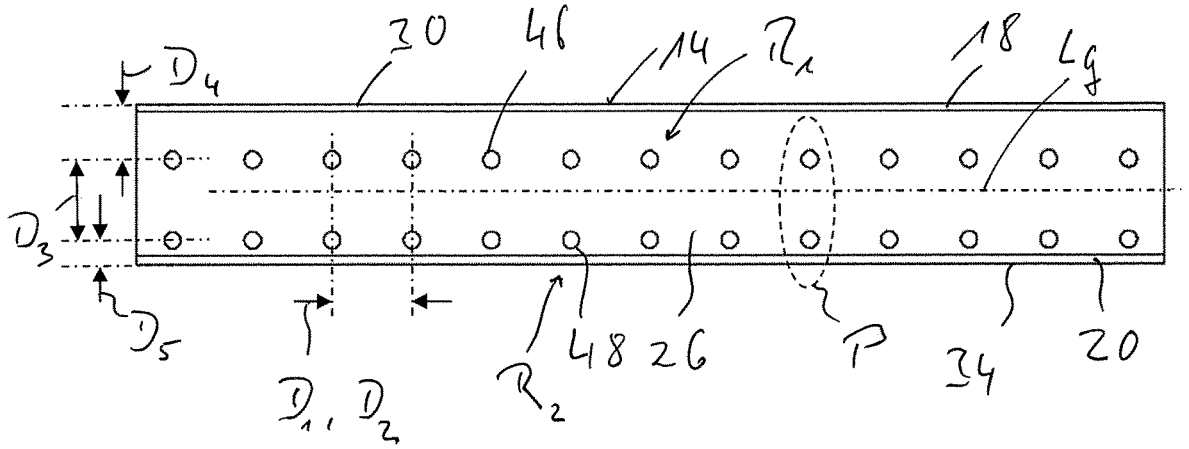
FIG. 3 is a side view of a profile support of the framework support of FIG. 1.
Figure 4:
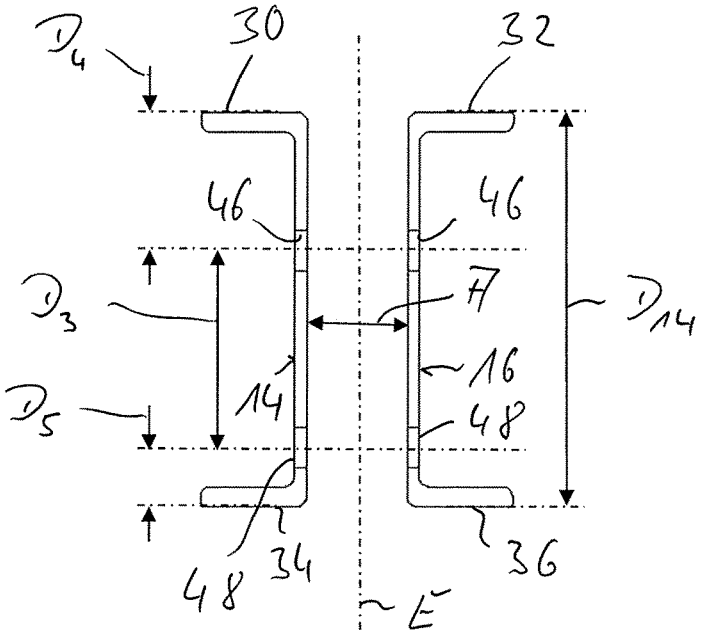
FIG. 4 is a front view of the two profile supports of the framework support of FIG. 1, positioned facing each other with respective profile webs.

A row $R_1$ of first profile support openings 46 is provided in each of the two profile supports 14, 16, as illustrated in FIG. 3 using the profile support 14. The first profile support openings 46 of the row $R_1$ are arranged one after the other in a framework support longitudinal direction $L_G$. First profile support openings 46 which follow one another directly in the framework support longitudinal direction $L_G$ are at a distance $D_1$ from one another, wherein this distance $D_1$ between directly adjacent first profile support openings 46 is preferably constant over the entire row $R_1$ of first profile support openings 46.

Likewise, each profile support 14, 16 has a row $R_2$ of second profile support openings 48. The second profile support openings 48 of row $R_2$ are also arranged one after the other in the profile support longitudinal direction $L_G$ and have a mutual distance $D_2$, which substantially corresponds to the distance $D_1$ of the first profile support openings 46 to one another in the profile support longitudinal direction $L_G$. Furthermore, the two rows $R_1$, $R_2$ are arranged in each of the profile supports 14, 16 in such a way that they have a distance $D_3$ to one another orthogonally to the longitudinal direction of the profile support $L_G$, which substantially corresponds to the distance $D_1$ and $D_2$, respectively. The two rows $R_1$, $R_2$ are further arranged in each of the profile supports 14, 16 in such a way that a second profile support opening 48 lies orthogonal to the profile support longitudinal direction $L_G$ next to each first profile support opening 46, so that respective pairs P of adjacent first and second profile support openings 46, 48 of the two rows $R_1$, $R_2$ are formed.

The row $R_1$ of first profile support openings 46 is arranged in the respective profile web 26, 28 so that it has a distance $D_4$ substantially orthogonal to the profile support longitudinal direction $L_G$ to the first profile support side surface 30, 32 of the first profile leg 18, 22 positioned closer to this row $R_1$, which is greater than a substantially orthogonal distance $D_5$ of the row $R_2$ of second profile support openings 48 to the second profile support side surface 34, 36 of the second profile leg 20, 24 which is closer to the respective row $R_2$.

Figure 5:
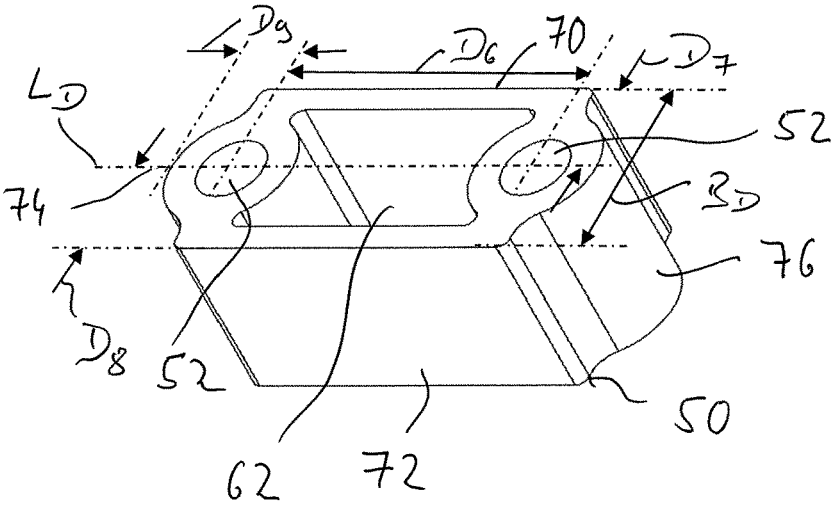
FIG. 5 is a perspective view of a spacer element of the framework support of FIG. 1.

FIG. 5 shows a spacer element 50, which is positioned between the two profile supports 14, 16 in the assembled state of a framework support 10. For a stable structure, several such spacer elements 50 are preferably arranged at different positions in the profile support longitudinal direction $L_G$ between the two profile supports 14, 16.

The spacer element 50 is elongated in a spacer element longitudinal direction $L_D$ and has two spacer element openings 52 which follow one another in the spacer element longitudinal direction $L_D$. A distance $D_6$ of the two spacer element openings 52 in the spacer element longitudinal direction $L_D$ to one another corresponds to the distance $D_1$ of the first profile support openings 46 to one another, the distance $D_2$ of the second profile support openings 48 to one another and the distance $D_3$ between a respective first profile support opening 46 and a respective one second profile support opening 48 of a respective pair P. This makes it possible to insert such a spacer element 50 either between the two profile supports 14, 16 in such a way that each of the two spacer element openings 52 is aligned with one of two directly adjacent first profile support openings 46, or that each of the two spacer element openings 52 are each aligned with one of two directly adjacent second profile support openings 48, or that one of the spacer element openings 52 is aligned with one of the two profile support openings 46, 48 of a pair P and the other spacer element opening 52 with the other of the profile support openings 46, 48 of this Pair P. This alignment is of course given for each of the two profile supports 16, 18.

To produce a solid connection, connecting elements 54 can be passed through the first profile support openings 46 or second profile support openings 48 of the two profile supports 14, 16 which are aligned with the two spacer element openings 52 of a respective spacer element 50. These connecting elements 54 can be designed, for example, as a screw bolt with a head 56 and a threaded shaft 58 onto which a nut 60 can be screwed.

To obtain an easy-to-handle structure, the two profile supports 14, 16 are preferably constructed with aluminum material and manufactured, for example, by extrusion. Likewise, each spacer element 50 can also be constructed with aluminum material and produced by cutting off an extruded profile with a thickness required to adjust the mutual distance A to be specified for the two profile supports 14, 16. Such an extruded profile can substantially be designed as a hollow profile, so that an inner opening 62 which runs substantially completely through it is formed in each spacer element 50 to minimize weight.

The two profile supports 14, 16 can, for example, be brought separately from one another to the intended installation location and can be assembled there with the required number of spacer elements 50 and connecting elements 54 to form a framework support 10.

Figure 10:
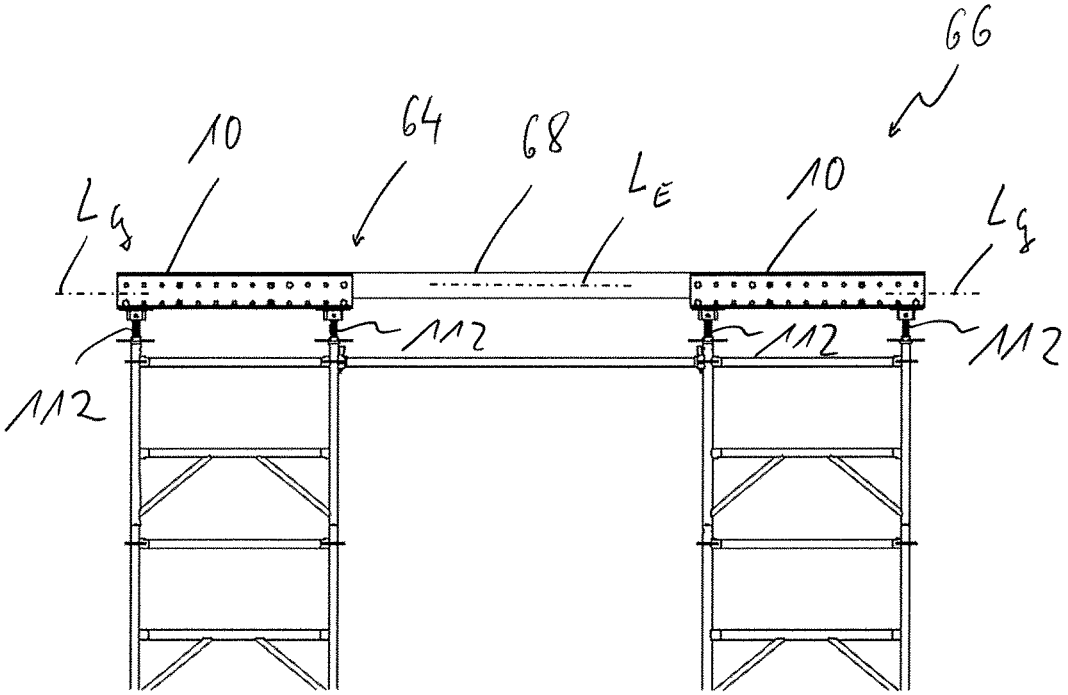
FIG. 10 is a framework support system comprising two framework supports connected to one another by an insertion element in a support structure constructed in the manner of a framework.
Figure 11:
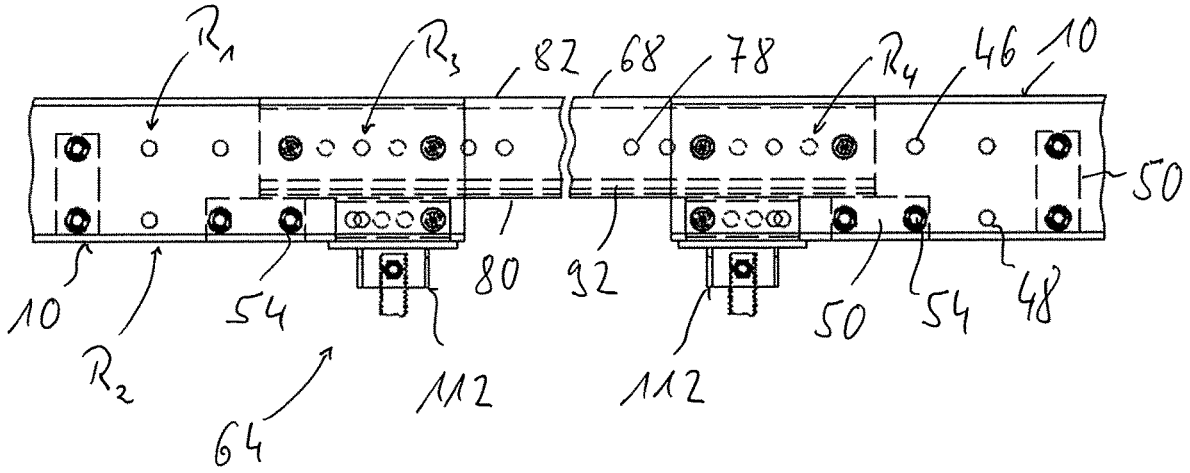
FIG. 11 is a detailed view of the framework support system shown in FIG. 10.

When assembling the profile supports 14, 16 with the spacer elements 50 to be arranged between them, different positionings of the spacer elements 50 can be provided, as mentioned above and illustrated in FIG. 11. The framework support system 64 shown in more detail in FIG. 11, which is shown integrated in a support structure 66 constructed in the form of a framework in FIG. 10, shows two framework supports 10 with the structure described above, which are coupled to an insertion element 68 described in more detail below. FIG. 11 illustrates different installation positions of spacer elements 50. It can be seen that in the end regions of the framework supports 10 shown, a spacer element 50 is installed in such a way that its spacer element longitudinal direction $L_D$ corresponds to the respective framework support longitudinal direction $L_G$, so that a spacer element 50 positioned in this way is firmly connected to the two profile supports 14, 16 of the framework supports 10 through connecting elements 54 passing through its spacer element openings 52 and respective second profile support openings 48. Since in a respective spacer element 50 the two spacer element openings 52 are arranged transversely to the spacer element longitudinal direction $L_D$ in a central region and have the same distance $D_7$ or $D_8$ from each of two mutually preferably substantially parallel spacer element side surfaces 70, 72, which also corresponds to the distance $D_5$ of the second profile support openings 48 to the respective second profile support side surface 34, 36, when a spacer element 50 is positioned in this way, one of the two spacer element side surfaces 70, 72 lies substantially flush with the two second profile support side surfaces 34, 36 and thus also contributes to the second framework support region 40.

A distance $D_9$ of a respective spacer element opening 52 in the spacer element longitudinal direction $L_D$ to a directly adjacent spacer element end face 74, 76 is smaller than the respective distance $D_7$ or $D_8$. This leads to the fact that, when installed in such a way, in which a spacer element 50 interacts with the two profile support openings 46, 48 of a respective pair P in each of the profile supports 14, 16, the spacer element 50 with its spacer element end face 74 or 76, which is curved in the example shown, which is positioned closer to the second framework support surface region 40, is set back inwards with respect to this.

Figure 6:
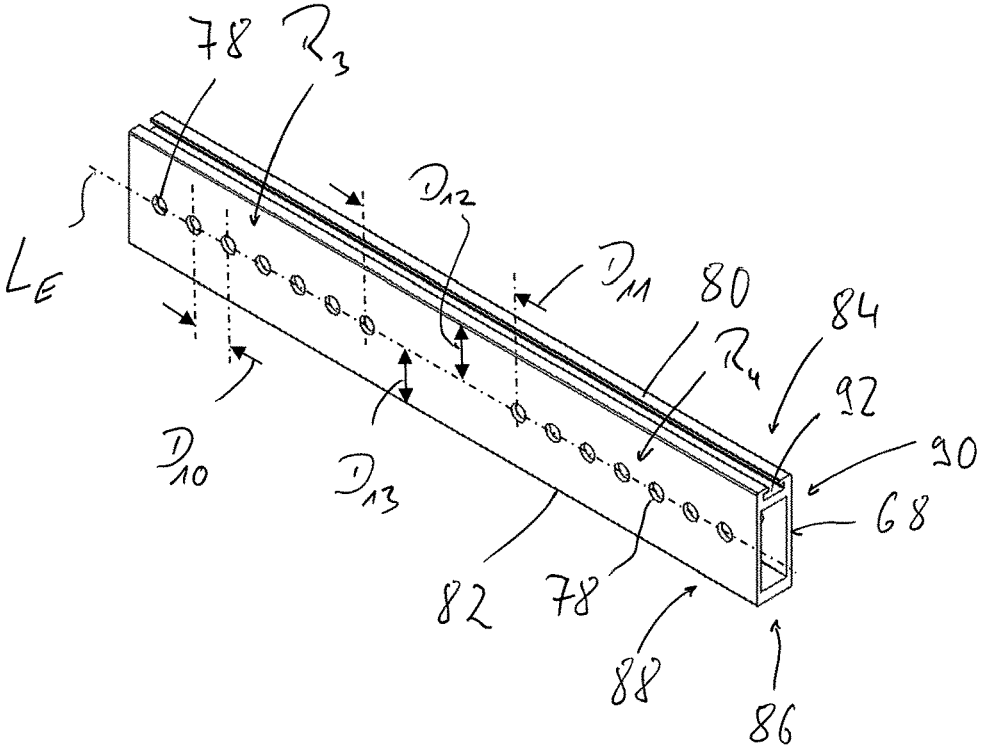
FIG. 6 is perspective view of an insertion element that can be coupled to the framework support of FIG. 1.
Figure 7:
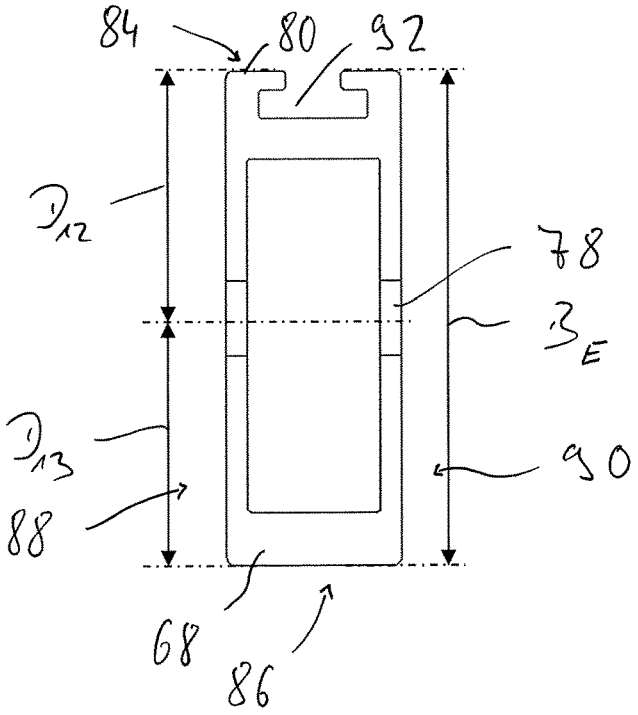
FIG. 7 is a front view of the insertion element of FIG. 6.

FIGS. 6 and 7 show an insertion element 68, which can be used with one or two framework supports 10 to build a respective framework support system 66. The insertion element 68 is also preferably constructed with aluminum material and, for example, by extrusion as a substantially box-like hollow profile. In the insertion element 68, two rows $R_3$, $R_4$ of insertion element openings 78 are formed successively in an insertion element longitudinal direction $L_E$. In each of the two rows $R_3$, $R_4$, insertion element openings which are directly adjacent to one another or which follow one another in the insertion element longitudinal direction $L_E$ have a distance $D_{10}$ which is smaller than a distance $D_{11}$ between the two rows $R_3$, $R_4$ or the directly adjacent insertion element openings 78 of different rows $R_3$, $R_4$. It should be noted that a single row of insertion element openings running in the insertion element longitudinal direction $L_E$ could also be formed in the insertion element 68. Likewise, a plurality of rows of first profile support openings 46 and/or rows of second profile support openings 48 arranged at a distance from one another in the profile support longitudinal direction $L_G$ could be provided in the profile supports 14, 16.

The insertion element openings 78 have the same distance $D_{12}$ or $D_{13}$ from respective insertion element side surfaces 80, 82 which are arranged at a distance from one another orthogonally to the insertion element longitudinal direction $L_E$ and are substantially parallel to one another, so that the insertion element openings 78 are positioned, orthogonal to the insertion element longitudinal direction $L_E$, centrally in the insertion element 68. It should also be noted that each insertion element opening 78 in the insertion element 68, which is designed as a hollow profile part, comprises an opening portion in each of the two opposing wall regions, so that a respective connecting element 54 can be completely passed through the insertion element 68.

The distance $D_{12}$ or $D_{13}$ of the insertion element openings 78 to the two insertion element side surfaces 80, 82 corresponds to the distance $D_4$ of the first profile support openings 46 to the respective first profile support side surface 30, 32. In the framework support system 64 illustrated in FIG. 11, in which the insertion element 68 is coupled in each of its longitudinal end regions to each of the two framework supports 10 in the region of the first profile support openings 46 by two connecting elements 54 arranged at a distance from one another in the direction of the insertion element longitudinal direction $L_E$ or also of the framework support longitudinal direction $L_G$, thus one of the two insertion element side surfaces 80, 82 is flush with the first profile support side surfaces 30, 32 of the two profile supports 14, 16 of the two framework supports 10 and thus contributes to the respective first framework support supporting surface region 38.

In a framework support system 64 constructed in this way, the insertion element 68 lies with each of its two longitudinal end regions directly adjacent to or above a spacer element 50. To make this possible, the spacer element 50 and the insertion element 68 are dimensioned such that a distance $D_{14}$ between a respective one first profile support side surface 30, 32 and second profile support side surface 34, 36 in each of the profile supports 14, 16 substantially corresponds to the sum of a width $B_D$ of the spacer element 50 measured between the two spacer element side surfaces 70, 72 and a width $B_E$ of the Insertion element 68 measured between the insertion element side surfaces 80, 82. At the same time, this also leads to a structure in which the insertion element 68 can rest in its longitudinal end regions on the spacer elements 50 of the two framework supports 10 or can also be additionally supported by them and in particular can also be blocked against a pivoting or walking movement.

In the insertion element 68, the insertion element openings 78 are arranged such that their distance $D_{10}$ in the insertion element longitudinal direction $L_E$ is smaller than the distance between first profile support openings 46 directly following one another in the framework support longitudinal direction $L_G$. In particular, the distance $D_{10}$ between directly adjacent insertion element openings 78 can be half the distance $D_1$ of directly adjacent first profile support openings 46. This enables a comparatively fine adjustment of the installation position of the insertion element 68 in a respective framework support 10 in the framework support longitudinal direction $L_G$. In particular, it can be provided that the distance $D_1$ corresponds to an integer multiple of the distance $D_{10}$, for example three or four times, in order to be able to achieve an even finer rasterization.

FIGS. 6 and 7 further show that the insertion element 68, which is constructed with a substantially rectangular cross-sectional profile and has narrow sides 84, 86 providing the respective insertion element side surfaces 80, 82 or broad sides 88, 90 running between them, has an undercut profile 92 in one the narrow sides 84, 86, that is open to the outside, i.e. in the region of the insertion element side surface 80, and which divides the insertion element side surface 80 into two portions running next to one another. One or more fastening elements designed in particular in the manner of hammer-head screws can be inserted into the undercut profile 92, through which support structure elements of a support structure can be coupled to the narrow side 84 of the insertion element 68, wherein the position of such a coupling in the insertion element longitudinal direction $L_E$ can be selected accordingly by corresponding displacement of the fastening elements used for this purpose.

Figure 8:
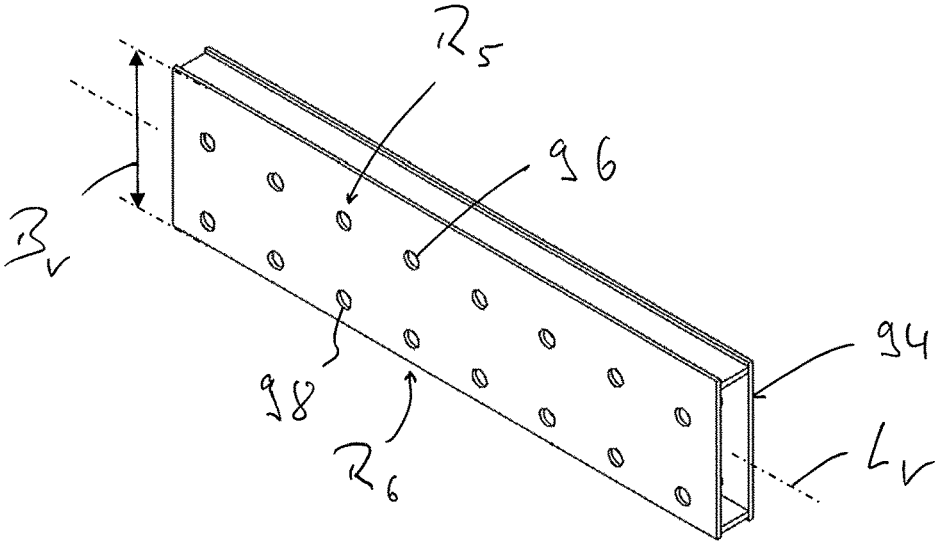
FIG. 8 is a perspective view of a framework support connecting element.
Figure 9:
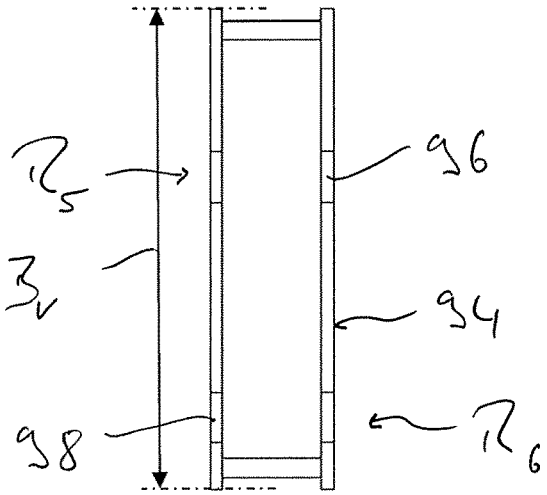
FIG. 9 is a front view of the framework support connecting element of FIG. 8.

FIGS. 8 and 9 show a further support structure element which can be used to build a framework support structure 64, for example to couple two framework supports 10 directly next to one another. This can be seen in the example of a support structure 66' illustrated in FIG. 15. There, three groups of three respective framework supports 10 following one another in the respective longitudinal direction $L_G$ are provided directly next to one another on a framework structure 95. For this purpose, a framework support connecting element 94 shown in FIGS. 8 and 9 can be used. The framework support connecting element 94 is also preferably made with aluminum material and, for example, by extrusion and is elongated in a connecting element longitudinal direction $L_V$. The width $B_V$ of the framework support connecting element 94 orthogonal to the connecting element longitudinal direction $L_V$ can substantially correspond to the distance $D_{14}$ between the respective first and second profile support side surfaces 30, 32 and 34, 36 in each of the profile supports 14, 16.

A row $R_5$ of first connecting element openings 96 and, orthogonal to the connecting element longitudinal direction $L_V$ at a distance therefrom, a second row $R_6$ of second connecting element openings 98 are provided in the framework support connecting element 94. These first connecting element openings 96 and second connecting element openings 98 are arranged in the framework support connecting element 94 in such a way that an opening pattern corresponding to the opening pattern of the first and second profile support openings 46, 48 is provided. The framework support connecting element 94 can thus be positioned in the adjacent region of two framework supports 10 to one another in such a way that the first and second connecting element openings 96, 98 provided therein are aligned with the respective first and second profile support openings 46, 48 in the two profile supports 14, 16 of the profile supports 10 to be connected to one another and the framework support connecting element 94 can be firmly connected to each framework support 10 by a plurality of connecting elements 54. The thickness of the framework support connecting element 94 substantially corresponds to the thickness of the spacer elements 50 arranged between the profile supports 14, 16 of the framework supports 10 to be connected to one another and thus to the distance A to be provided between the two profile support end faces 42, 44.

Figure 13:
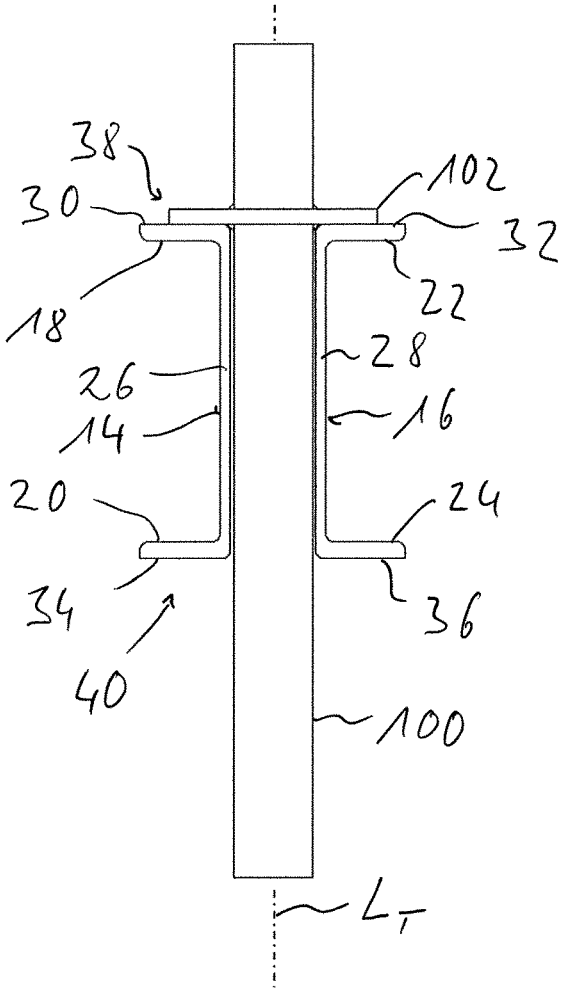
FIG. 13 is a front view of two profile supports of a framework support with a vertical support of a framework arranged therebetween.
Figure 14:
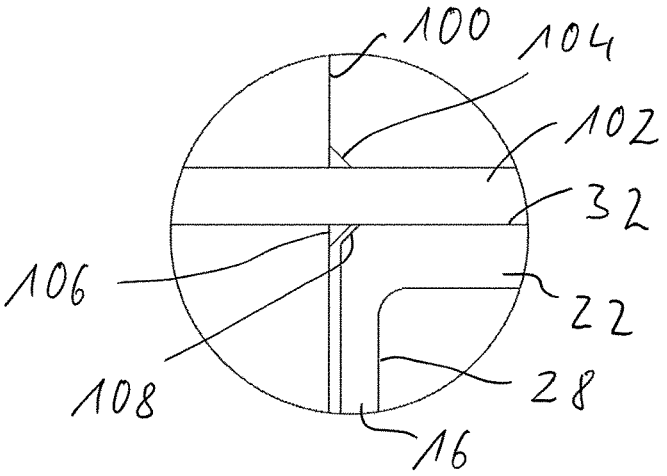
FIG. 14 is an enlarged detailed view of the vertical support resting on a profile support.

This distance A is dimensioned such that when building a support structure, it is possible to pass support structure elements of the same between the two profile supports 14, 16 of a framework support 10. This is illustrated in FIGS. 13 and 14. In this example, such a support structure element 101 passed between the two profile supports 14, 16 of the framework support 10 is a vertical support 100 used to build a framework structure. Such a tubular vertical support 100 can have coupling elements at several length positions, such as by carrying a perforated disk 102, which is connected to the tubular body of the vertical support 110 by preferably completely circumferential welds 104, 106. In order to enable such a vertical support 100 with one of its perforated disks 102 to rest, for example, on the first profile support side surface 30, 32 of the two profile supports 14, 16, without this causing mutual interference or contact with one of the two weld seams 104, 106, the profile supports 14, 16 are designed such that a chamfer 108 is formed in the transition region from a respective profile support end face 42, 44 to a respective first profile support side surface 30, 32. In the exemplary embodiment shown, the weld seam 106 can be immersed in the space provided, so that the perforated disk 102 can be placed flatly on the first framework support surface region 38 provided by the two profile support side surfaces 30, 32. In order to enable a similar support interaction with respect to the second framework support surface region 40, it is advantageous to also provide such a chamfer 110 in the transition between the profile support end faces 42 44 and the second profile support side surfaces 34, 36. It should be noted that instead of the chamfers, roundings can also be formed in the respective transition regions, through which the space required to accommodate a respective weld seam 104 or 106 is provided.

Figure 12:
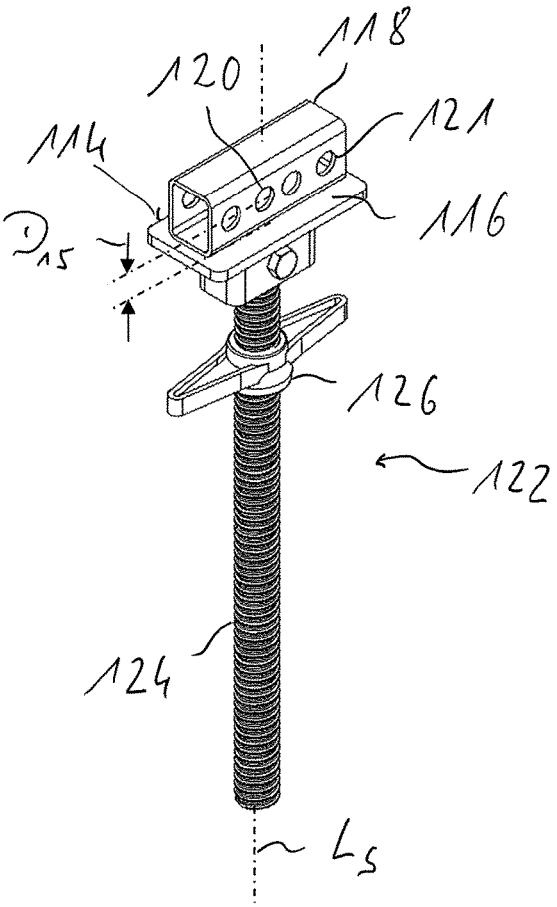
FIG. 12 is a perspective view of a framework support supporting element.

In addition, one or more support elements 112 may be used to construct a support structure 64 or 66'. Such a framework support supporting element 112 is illustrated in FIG. 12.

The framework support supporting element 112 has a support head 114, which provides a framework support surface 116. A connecting web 118 is provided approximately in the middle of the framework support surface 116, in which a plurality of connecting web openings 120 are each provided at the same distance $D_{15}$ from the framework support surface 116. The distance $D_{15}$ corresponds to the distance $D_5$ of the second profile support openings 48 to the respective second profile support side surface 34, 36 for each of the profile supports 14, 16.

In the framework support system 64 shown in FIG. 11, each of the two framework supports 10 rests in one of its longitudinal end regions on the framework support supporting surface 116 of a framework support supporting element 112. By moving the framework support supporting element 12 in the direction of the framework support longitudinal direction $L_G$, one of the connecting web openings 120 can be aligned with one of the second profile support openings 48 formed in the profile supports 14, 16, so that a connecting element 54 can be passed through these mutually aligned openings can and a respective framework support 10 can be secured against detachment from the associated framework support supporting element 112.

The mutual distance between the connecting web openings 120 can vary or can be selected in such a way that when using such a framework support supporting element 112 with variously dimensioned support structure elements of a framework, for example vertical supports combined in frame-like structures, it is possible to align several of framework support supporting elements 112 positioned in this way at a fixed predetermined distance from one another with one or more framework supports 10 or the second profile support openings 48 provided therein.

The framework support supporting element 112 shown in FIG. 12 further comprises a spindle arrangement, generally designated 122, with an externally threaded shaft 124 coupled to the support head 114 and a spindle nut 126 which can be rotated thereon and thus changed in position in its longitudinal direction. This spindle arrangement 122 or the externally threaded shaft 124 thereof can, for example, be inserted into the upper end of a vertical support of a framework structure until the spindle nut 126 rests against it. By turning the spindle nut 126, the external threaded shaft 124 and with it the support head 114 can then be adjusted in its positioning with respect to such a vertical support, for example substantially in the vertical direction or in the height direction, in order to also achieve the desired installation position for a framework support 10 supported on such a framework support supporting element.

Figure 15:
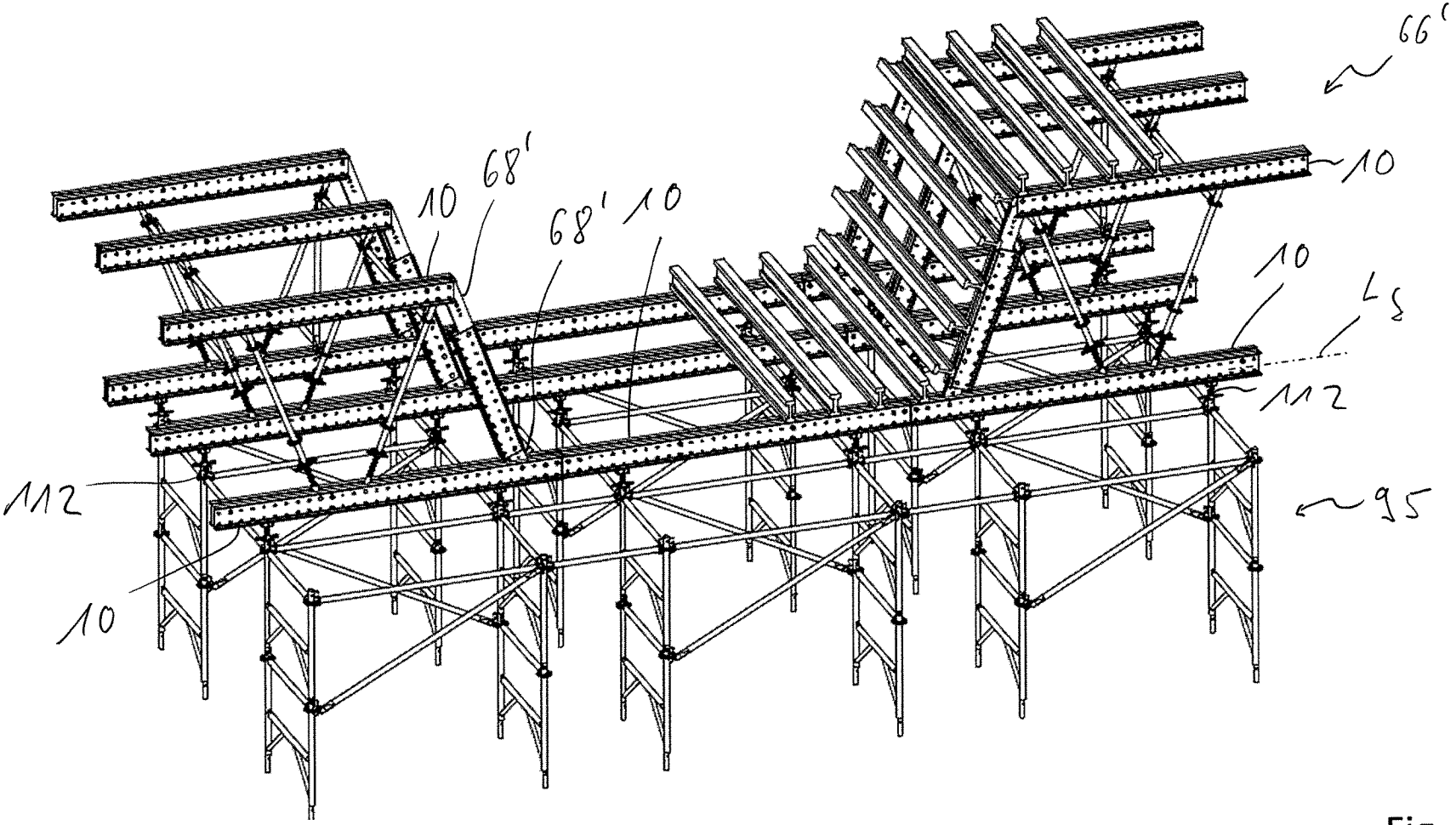
FIG. 15 is a support structure constructed in the manner of a formwork structure on a framework with a plurality of framework supports.

With such a framework support 10 or framework support system 64, as illustrated for example in FIGS. 10 and 15, different designed support structures 66 and 66' can be built. Such support structures 66, 66', as is the case of the support structure 66 shown in FIG. 10, may be constructed according to the type of framework on which loads are to be supported, depending on the purpose, or, as is the case of the support structure 66', may be used for the construction of a formwork structure, for example, in bridge construction. Such a framework support system 64 described above offers a high degree of variability while still having a stable structure. If, for example, two framework supports 10, as illustrated in FIGS. 10 and 11, are coupled to an insertion element 68 in such a way that the insertion element 68 is coupled in each of its longitudinal end regions by at least two connecting elements 54 arranged at a distance from one another in the insertion element longitudinal direction $L_E$ with the framework supports 10, a very rigid overall structure is achieved, in which deflection of the insertion elements 68, which are stably supported in both longitudinal end regions, is greatly limited.

If an insertion element 68 is coupled with a framework support 10 only by means of a single connecting element 54, as illustrated in FIG. 15 in the insertion elements 68', the insertion element 68' is rotatable with respect to the framework support 10 coupled thereto around the connecting element 54, such as its longitudinal axis $L_G$, so that any angle between the insertion element 68' and the framework support 10 connected thereto by just one single connecting element can be adjusted. This leads to a high degree of variability in the construction of a support structure 66.

Another particularly advantageous design aspect of a framework support system 64 according to the invention or a support structure constructed therewith is explained below with reference to FIGS. 16 to 20.

Figure 16:
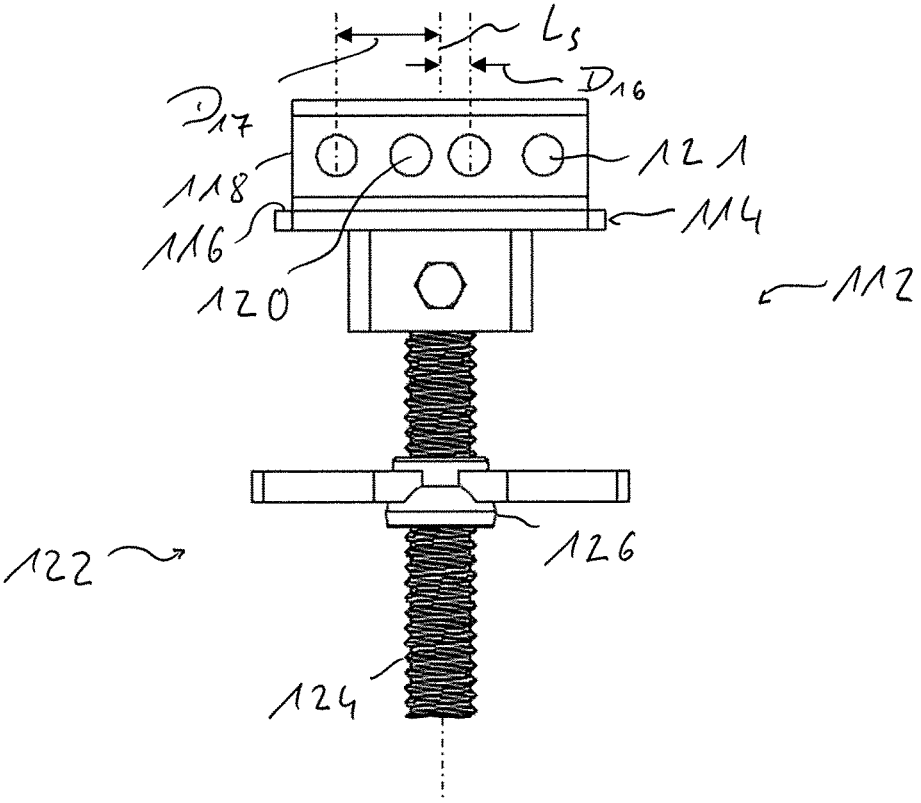
FIG. 16 is a side view of the framework support supporting element of FIG. 12.

FIG. 16 shows the framework support supporting element 12, already described above with reference to FIG. 12, with its support head 114 and the spindle arrangement 122. It can be clearly seen that several connecting web openings 120, 121 are provided in the connecting web 118. Two first connecting web openings 120 have a distance $D_{16}$ from a framework support supporting element longitudinal axis $L_S$, which is smaller than a distance $D_{17}$, at which two second connecting web openings 121 are arranged to the framework support supporting element longitudinal axis $L_S$, which substantially also corresponds to or is defined by the longitudinal axis of the externally threaded shaft 124. In the connecting web 118, a pair of first connecting web openings 120, which are opposite one another with respect to the framework support supporting element longitudinal axis $L_S$, and a pair of second connecting web openings 121, which are opposite one another with respect to the framework support supporting element longitudinal axis $L_S$, are provided. This makes it possible to couple such a framework support supporting element 112 to a framework support 10 in the same way, regardless of the direction in which the connecting web 118 is aligned.

FIGS. 17 to 20 show the variability in the use of the framework support supporting elements 112, which are generally used in such a way that they are inserted with their external thread 124 in an open end of, for example, tubular support structure elements 100, 101', for example, which are used as vertical supports and can be coupled to each other by horizontal bars or can be grouped together in a rigid frame. In an external thread 124 inserted into a respective support structure element 100, 101', the spindle nut 126 lies at the top end of the respective support structure element 100, 101' and thus defines the positioning of the support head 114 serving to support a particular framework support 10.

All configurations of framework systems 64 shown in FIGS. 17 to 20 are designed in such a way that the following conditions A to C are met $$A:\ D_{T1} = n_1 \times D_2 + 2 \times D_{16}$$

$$B:\ D_{T2} = n_2 \times D_2 - 2 \times D_{17}$$

$$C:\ D_{T3} = n_3 \times D_2 + D_{16} + D_{17}$$

If these conditions are met, it is possible to build various framework support systems 64 with a type of framework support supporting elements 112, as shown for example in FIG. 16, in which the support structure elements 101, 101' are positioned at predetermined distances from one another predetermined by specifications of a support structure, such as a framework. Such dimensional specifications can result, for example, from standardized dimensions in such support structures or frameworks.

Figure 17:
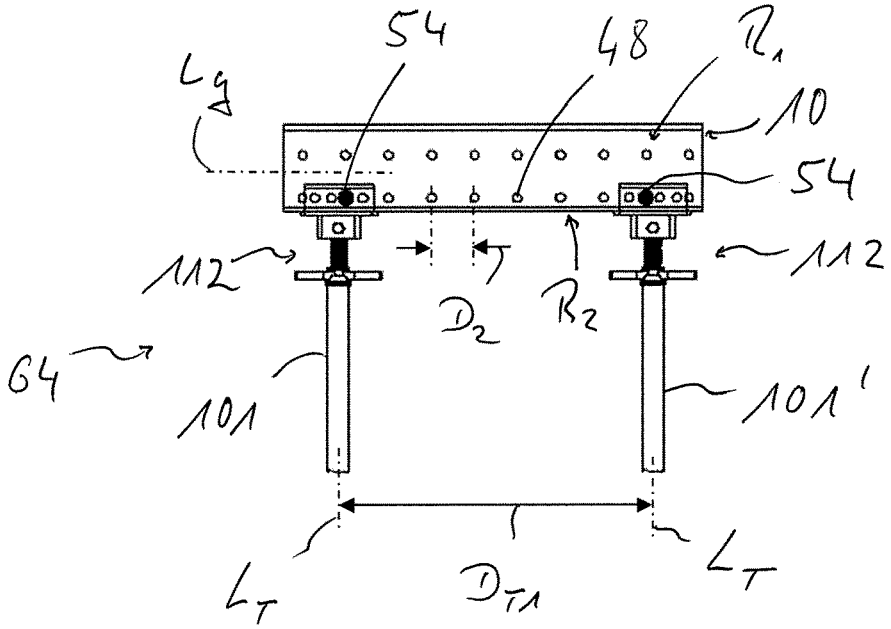
FIG. 17 is a framework support system with two support structure elements coupled to a framework support and arranged at a predetermined distance from one another.

In the frame support system 64 of FIG. 17, the two support structure elements 101, 101' are arranged in such a way that their support structure longitudinal axes $L_T$ have a mutual distance $D_{T1}$, which can, for example, be 732 mm. This support structure element distance $D_{T1}$ does not correspond to an integer multiple of the distance $D_2$ of the second profile support openings 48 with which the two framework support supporting elements 112 are to be coupled. This distance $D_2$ can be, for example, 100 mm, so that the mutual distance between the second profile support openings 48 is an integer multiple of this distance $D_2$, i.e. an integer multiple of 100 mm. With a support structure element distance $D_{T1}$ of 732 mm, there is an oversize of 32 mm with respect to two second profile support openings 48, which are arranged at a distance of 700 mm from one another, the mutual distance of which corresponds to seven times the distance $D_2$.

In order to compensate for this oversize, the distance $D_{16}$ of the first connecting web openings 120 to the framework support supporting element longitudinal axis $L_S$, which corresponds to the respective support structure element longitudinal axis $L_T$ in the framework support system 64 shown in FIG. 17, is dimensioned such that it is 16 mm. This means that the two first connecting web openings 120, which are positioned closer to one another, are then exactly at a distance of 700 mm from one another and can therefore be positioned aligned with two second profile support openings 48 which are at a distance of 700 mm from one another. A respective connecting element 54 can then be passed through these mutually aligned second profile support openings 48 and first connecting web openings 120 in order to firmly connect the framework support 10 and the two framework support supporting elements 112 to one another.

In the example shown in FIG. 17, the size $n_1$ used in condition A corresponds to the number 7. The support structure element distance $D_{T1}$ is 732 mm, the distance $D_2$ between two directly adjacent second profile support openings 48 is 100 mm, and the distance $D_{16}$ of the respective first connecting web opening 120 to the framework support supporting element longitudinal axis $L_S$ of a respective framework support supporting element 112 is 16 mm.

Figure 18:
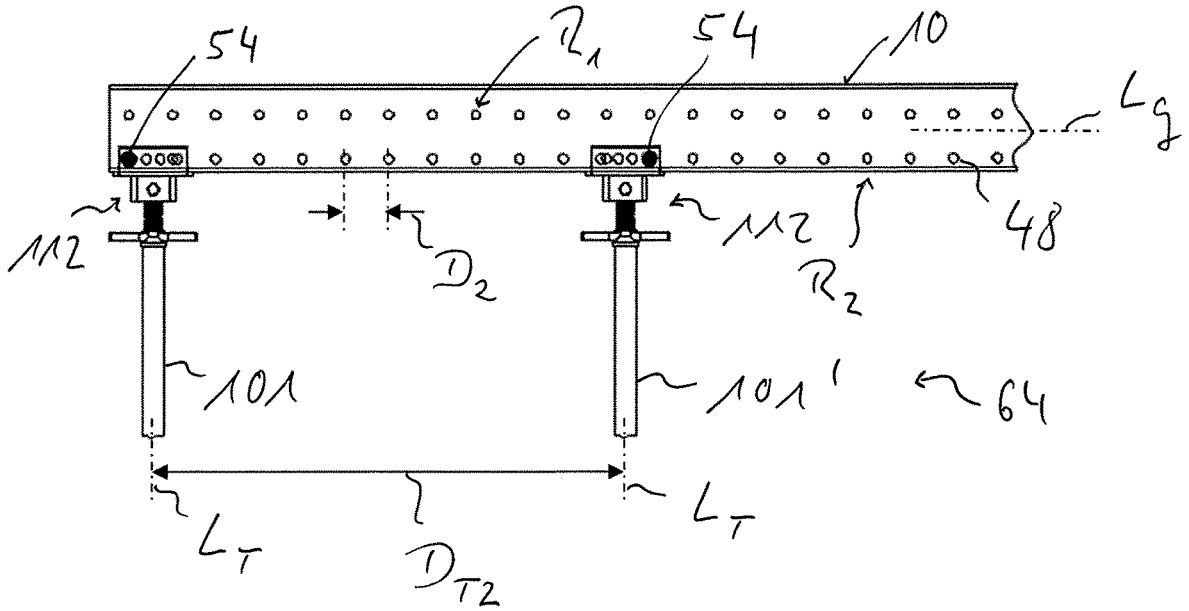
FIG. 18 is a representation corresponding to FIG. 17 of a framework support system with two support structure elements arranged at a different predetermined distance from one another.

FIG. 18 illustrates an exemplary embodiment in which the two support structure elements 100, 101' have a mutual distance $D_2$ of 1088 mm. The two second profile support openings 48, via which the framework support 10 is to be coupled to the framework support supporting elements 112, have a distance in the framework support longitudinal direction $L_G$ of 1200 mm. This results in an undersize of the support structure element distance $D_{T2}$ of 112 mm.

The distance $D_{17}$ of the second connecting web openings 121 to the framework support supporting element longitudinal axis $L_S$ is set to 56 mm, so that in the two second connecting web openings 121 of the two framework support supporting elements 112 facing away from each other, their mutual distance is 1200 mm and thus these two second connecting web openings 121 can be aligned with the two second framework support openings 48, which are arranged at a distance of 1200 mm from one another, and can be coupled by respective connecting elements 54.

In this case, in condition B, the number $n_2$ is 12, the support structure element distance $D_{T2}$ is 1088 mm, the distance $D_{17}$ of the second connecting web openings 121 to be used to the framework support supporting element longitudinal axis $L_S$ of the respective framework support supporting element 112 is 56 mm, and the distance between two directly adjacent second profile support openings 48 is again 100 mm.

Figure 19:
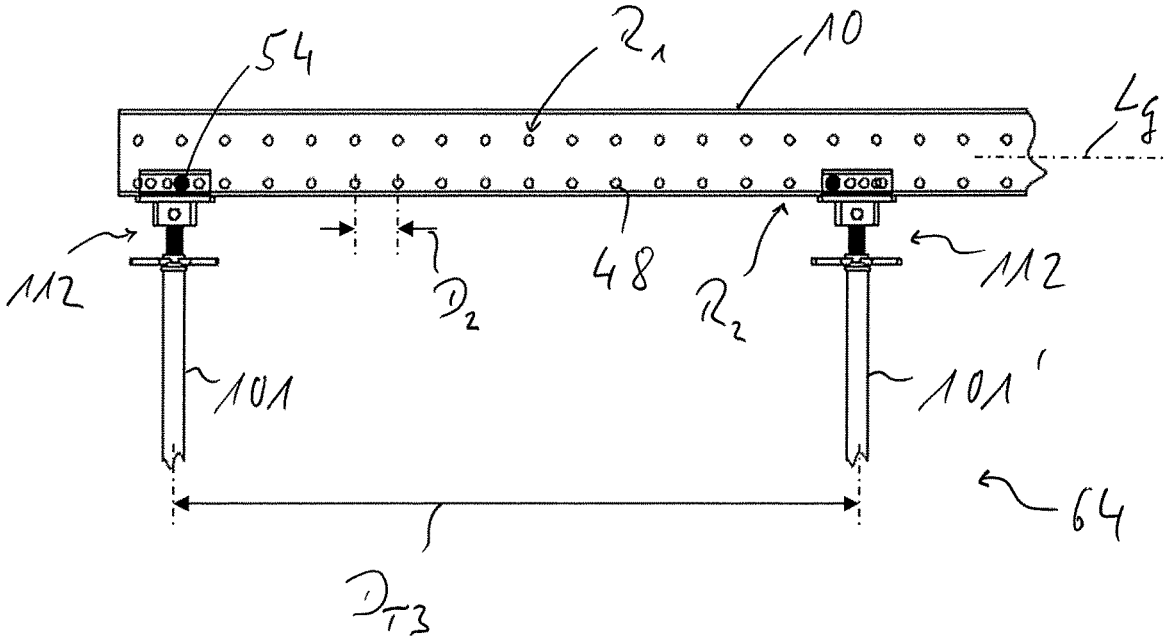
FIG. 19 is a representation corresponding to FIG. 17 of a framework support system with two support structure elements arranged at a different predetermined distance from one another.

FIG. 19 illustrates an exemplary embodiment in which the mutual distance between the support structure element longitudinal axes $L_T$ of the two support structure elements 101, 101' is 1572 mm. By using the first connecting web opening 120 in one of the framework support supporting elements 122, which is closer to the other support element 112, e.g. the framework support supporting element 112 provided at the support structure element 101, and by using the second connecting web opening closer to that framework support supporting element 112 of the other support element 112, provided at the support structure element 101', it will be possible to couple the two framework support supporting elements 112 with the second profile support openings 48, which have a mutual distance in the framework support longitudinal direction $L_G$ of 1500 mm. The oversize of the 100, 101' support structure elements arranged at the support structure distance $D_{T3}$ with respect to the second profile support openings 48 to be used is 72 mm, resulting from the sum of distance $D_{16}$ of 16 mm and distance $D_{17}$ of 56 mm can be compensated for at a first connecting web opening 120 or second connecting web opening 121 of the two framework support supporting elements 112.

In the exemplary embodiment of a framework support system 64 shown in FIG. 19, under condition C the number $n_3$ is 15, the support structure element distance $D_{T3}$ is 1572 mm, the distance $D_2$ between two directly adjacent second profile support openings 48 is again 100 mm, the distance $D_{16}$ of the first connecting web opening 120 to be used to the framework support supporting element longitudinal axis $L_S$ of one of the framework support supporting elements 112 is 16 mm, and the distance $D_{17}$ of the second connecting web opening 120 to be used to the framework support supporting element longitudinal axis $L_S$ of the other framework support supporting element 112 is 56 mm.

The preceding explanation shows that by selecting the different sizes that meet the conditions A to C, it is possible to realize more than two different support structure element distances that do not correspond to an integer multiple of the distance $D_2$ with just two differently positioned types of connecting web openings 120, 121.

Figure 20:
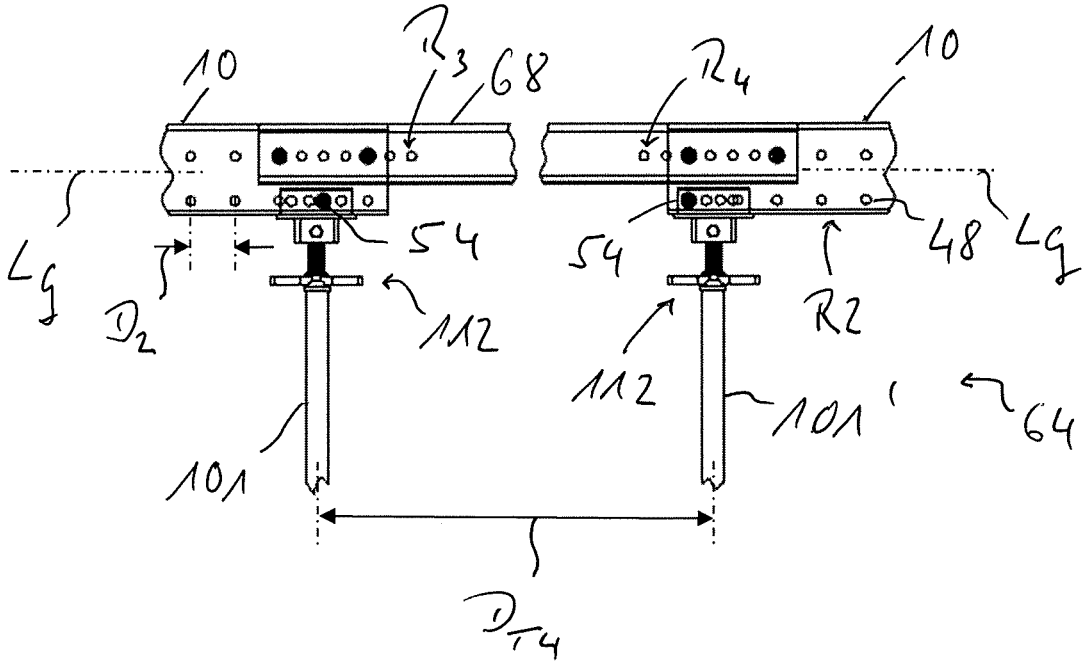
FIG. 20 is a representation corresponding to FIG. 17 of a framework support system with two support structure elements arranged at a different predetermined distance from one another.

The number of support structure element distances that can be achieved naturally increases in each of the exemplary embodiments of framework support systems 64 shown in FIGS. 17 to 19 when the support structure element distance increases or decreases by a distance $D_2$ or an integer multiple of the distance $D_2$, so that accordingly only the respective number $n_i$ changes. This is shown in FIG. 20 using the framework support system of FIG. 64. In the frame support system 64 shown in FIG. 2, the two support structure elements 101, 101' have an even greater support structure element distance $D_{T4}$ of, for example, 2072 mm to each other. With regard to the support structure element distance $D_{T3}$ of the framework support system of FIG. 19, only the number n has increased by 5. The two framework support supporting elements 112 can therefore be positioned with their connecting webs 118 exactly as is the case with the framework support system of FIG. 64 in order to compensate for an oversize of the support structure element distance $D_{T4}$, which is also 72 mm in this case. The same applies also to the framework systems of FIGS. 17 and 18. In this case also, the same support elements 112 can be used to fulfill the conditions A and B respectively by increasing or changing the numbers $n_1$ and $n_2$ respectively, if the distance between the support structure elements 101, 101' to be coupled to one or two framework supports 10 changes by an integer multiple of the distance $D_2$ of the second profile support openings 48 in relation to the distance indicated in each of these examples.

It should also be noted that the conditions A to C can be met with a variety of other support structure element distances $D_{Ti}$ using the same framework support supporting elements 112, for example if these support structure element distances $D_{Ti}$ are increased by multiplying by an integer, for example 2.

The invention claimed is:

1. A framework support, comprising two U-shaped profile supports which are elongated in a framework support longitudinal direction, each with two profile legs and a profile web connecting the two profile legs to one another, wherein the two profile supports are detachably connected to one another by means of a plurality of connecting elements, wherein the profile webs of the profile supports face one another, with interposition of at least one spacer element wherein in the profile web of each of the profile supports is at least one row of first profile support openings following one another in the framework support longitudinal direction for the passage of a connecting element and at least one row of second profile support openings arranged at a distance from the at least one row of first profile support openings orthogonally to the framework support longitudinal direction and following each other in the framework support longitudinal direction are designed for the passage of a connecting element, and wherein:

a distance from first profile support openings directly following one another in the framework support longitudinal direction substantially corresponds to a distance of second profile support openings directly following one another in the framework support longitudinal direction, or/and a distance between the at least one row of first profile support openings and the at least one row of second profile support openings orthogonal to the framework support longitudinal direction substantially corresponds to the distance of first profile support openings directly following one another in the framework support longitudinal direction and/or the distance of second profile support openings directly following one another in the framework support longitudinal direction, or/and a plurality of successive pairs in the framework support longitudinal direction is formed with a respective first profile support opening and a second profile support opening, wherein in each pair of a first profile support opening and a second profile support opening the two profile support openings are substantially not offset relative to one another in the framework support longitudinal direction, wherein for each of the profile supports, a first of the profile legs provides a first profile support side surface and a second of the profile legs provides a second profile support side surface, wherein the first profile support side surfaces of the first profile legs together provide a first framework support supporting surface region and the second profile support side surfaces of the second profile leg together provide a second framework support supporting surface region, and for each of the profile supports, a distance between the first profile support openings positioned closer to the first profile leg and the first profile support side surface is greater than a distance between the second profile support openings positioned closer to the second profile leg and the second profile support side surface.

2. The framework support according to claim 1, wherein in association with each first profile support opening, a second profile support opening is provided for forming one of said pairs of first and second profile support openings.

3. The framework support according to claim 1, wherein for each of the profile supports, a first of the profile legs provides a first profile support side surface and a second of the profile legs provides a second profile support side surface, wherein the first profile support side surfaces of the first profile legs together provide a first framework support supporting surface region and the second profile support side surfaces of the second profile leg together provide a second framework support supporting surface region.

4. The framework support according to claim 3, wherein for each of the profile supports, in the transition from the first profile support side surface to a profile support end face formed on the profile web and facing the other profile support, a chamfer or rounding is formed, and/or in that for each profile support, in the transition from the second profile support side surface to the profile support end face, a chamfer or rounding is formed.

5. The framework support according to claim 1 wherein at least one spacer element is elongated in a spacer element longitudinal direction and has at least two spacer element openings following one another in the spacer element longitudinal direction for the passage of a connecting element.

6. The framework support according to claim 5, wherein a distance between at least two spacer element openings, corresponds to the distance or an integer multiple of the distance between two first profile support openings and/or to the distance or an integer multiple of the distance between two second profile support openings.

7. The framework support according to claim 5 wherein at least one, spacer element has spacer element end faces spaced apart from one another in the spacer element longitudinal direction, and wherein in at least one spacer element end face, a distance between a spacer element opening which is adjacent to the spacer element end face and the spacer element end face in the direction of the spacer element longitudinal direction is less than or equal to the distance between the second profile support openings and the second profile support side surface for each of the profile supports, and/or wherein at least one spacer element has spacer element side surfaces which are spaced apart from one another orthogonally to the spacer element longitudinal direction, and in that in at least one spacer element side surface a distance between the spacer openings following one another in the spacer longitudinal direction and the spacer side surface, corresponds substantially to the distance between the second profile support openings and the second profile support side surface in each of the profile supports, wherein for each of the profile supports, a distance between the first profile support openings positioned closer to the first profile leg and the first profile support side surface is greater than a distance between the second profile support openings positioned closer to the second profile leg and the second profile support side surface, and wherein for each of the profile supports, a first of the profile legs provides a first profile support side surface and a second of the profile legs provides a second profile support side surface, wherein the first profile support side surfaces of the first profile legs together provide a first framework support supporting surface region and the second profile support side surfaces of the second profile leg together provide a second framework support supporting surface region.

8. The framework support according to claim 1, wherein at least one profile support is manufactured with aluminum material, and/or wherein at least one spacer element is manufactured with aluminum material.

9. A framework support system, comprising at least one framework support according to claim 1 and at least one insertion element elongated in an insertion element longitudinal direction and/or at least one framework support supporting element and/or at least one framework support connecting element elongated in a connecting element longitudinal direction.

10. The framework support system according to claim 9, wherein in the at least one insertion element at least one row of insertion element openings following one another in the insertion element longitudinal direction is provided for the passage of a connecting element, wherein the distance between at least two first 6 profile support openings and/or the distance between at least two second profile support openings substantially corresponds the distance or an integer multiple of the distance between at least two insertion element openings following one another in the insertion element longitudinal direction.

11. The framework support system according to claim 10, wherein at least two rows of insertion element openings are provided in the at least one insertion element, said at least two rows of insertion element openings following one another in the insertion element longitudinal direction, wherein a distance of directly adjacent insertion element openings in each row of insertion element openings is smaller than a distance of directly adjacent insertion element openings of different rows of insertion element openings.

12. The framework support system according to claim 10 wherein the at least one insertion element has insertion element side surfaces which are spaced apart from one another orthogonally to the insertion element longitudinal direction, and in that at least one row of insertion element openings directly following each other in the insertion element longitudinal direction has substantially the same distance to each insertion element side surface.

13. The framework support system according to claim 9, wherein at least one insertion element has a substantially rectangular cross-sectional profile with opposing narrow sides and opposing broad sides, and in that, on at least one narrow side, an outwardly open undercut profile is provided, and/or wherein at least one insertion element is made with aluminum material.

14. The framework support system according to claim 9, wherein at least one framework support supporting element has a support head with a framework support supporting surface and a connecting web protruding from the framework support surface to be positioned between the two profile supports of a framework support with at least one connecting web opening for the passage of a connecting element, and/or in that at least one framework support supporting element comprises a spindle arrangement.

15. The framework support system according to claim 14, wherein a distance of the at least one connecting web opening to the framework support surface substantially corresponds to the distance of the first profile support openings to the first profile support side surface for each of the profile supports or the distance of the second profile support openings to the second profile support side surface for each profile support, wherein for each of the profile supports, a distance between the first profile support openings positioned closer to the first profile leg and the first profile support side surface is greater than a distance between the second profile support openings positioned closer to the second profile leg and the second profile support side surface, and wherein for each of the profile supports, a first of the profile legs provides a first profile support side surface and a second of the profile legs provides a second profile support side surface, wherein the first profile support side surfaces of the first profile legs together provide a first framework support supporting surface region and the second profile support side surfaces of the second profile leg together provide a second framework support supporting surface region.

16. The framework support system according to claim 14 wherein at least one first connecting web opening and at least one second connecting web opening are provided in the connecting web, wherein a distance of the at least one first connecting web opening to a framework support supporting element longitudinal axis is smaller than a distance of the at least one second connecting web opening to the framework support supporting element longitudinal axis.

17. The framework support system according to claim 16, wherein in the connecting web, two first connecting web openings are provided opposite one another with respect to the framework support supporting element longitudinal axis, and/or wherein in the connecting web, two second connecting web openings are provided opposite one another with respect to the framework support supporting element longitudinal axis.

18. The framework support system according to claim 9, wherein for each profile support, a distance between the first profile support side surface and the second profile support side surface substantially corresponds to the sum of a width of at least one spacer element between two spacer element side surfaces which are spaced apart from one another orthogonally to a spacer element longitudinal direction and a width of at least one insertion element between two insertion element side surfaces located at a distance from one another orthogonal to an insertion element longitudinal direction, wherein for each of the profile supports, a first of the profile legs provides a first profile support side surface and a second of the profile legs provides a second profile support side surface, wherein the first profile support side surfaces of the first profile legs together provide a first framework support supporting surface region and the second profile support side surfaces of the second profile leg together provide a second framework support supporting surface region.

19. A support structure comprising at least one framework support system according to claim 9.

20. The support structure according to claim 19, wherein at least one insertion element or/and at least one framework support connecting element in at least one of its longitudinal end regions is connected to a framework support by at least two coupling elements positioned in the framework support longitudinal direction at a distance from each other, or/and wherein at least one insertion element is connected to a framework support by a single coupling element in at least one of its longitudinal end regions.

21. The support structure according to claim 19, wherein at least one framework support supporting element has a support head with a framework support supporting surface and a connecting web protruding from the framework support surface to be positioned between the two profile supports of a framework support with at least one connecting web opening for the passage of a connecting element, wherein at least one first connecting web opening and at least one second connecting web opening are provided in the connecting web, wherein a distance of the at least one first connecting web opening to a framework support supporting element longitudinal axis is smaller than a distance of the at least one second connecting web opening to the framework support supporting element longitudinal axis, and wherein two support structure elements, each to be coupled to a framework support or different framework supports by means of a framework support supporting element associated with them, have a support structure element distance from a plurality of predetermined support structure element distances from one another, and wherein support structure element distances of the plurality of support structure element distances, the distance of the at least one first connecting web opening to the framework support supporting element longitudinal axis, the distance of the at least one second connecting web opening to the framework support supporting element longitudinal axis and the distance of the profile support openings provided for coupling to the framework support supporting elements associated with the two support structure elements, directly following one another in the framework support longitudinal direction, of first profile support openings and second profile support openings of the framework support or of the different framework supports meet the following conditions:

$$A:\ D_{T1} = n_1 \times D_2 + 2 \times D_{16}$$

$$B:\ D_{T2} = n_2 \times D_2 - 2 \times D_{17}$$

$$C:\ D_{T3} = n_3 \times D_2 + D_{16} + D_{17}$$

wherein:

DT1, DT2, DT3 are support structure element distances from the plurality of support framework distances, n1, n2, n3 are integers, D2 is the distance of the profile support openings directly following one another in the framework support longitudinal direction of the profile support openings provided for coupling with the framework support supporting elements associated with the two support structure elements of first profile support openings and second profile support openings of the framework support or the various framework supports, D16 is the distance of the at least one first connecting web opening to the framework support supporting element longitudinal axis, D17 is the distance of the at least one second connecting web opening to the framework support supporting element longitudinal axis.

22. A support structure comprising at least one framework support, said framework support, comprising two U-shaped profile supports which are elongated in a framework support longitudinal direction, each with two profile legs and a profile web connecting the two profile legs to one another, wherein the two profile supports are detachably connected to one another by means of a plurality of connecting elements, wherein the profile webs of the profile supports face one another, with interposition of at least one spacer element, wherein in the profile web of each of the profile supports is at least one row of first profile support openings following one another in the framework support longitudinal direction for the passage of a connecting element and at least one row of second profile support openings arranged at a distance from the at least one row of first profile support openings orthogonally to the framework support longitudinal direction and following each other in the framework support longitudinal direction are designed for the passage of a connecting element, and wherein:

a distance from first profile support openings directly following one another in the framework support longitudinal direction substantially corresponds to a distance of second profile support openings directly following one another in the framework support longitudinal direction, or/and a distance between the at least one row of first profile support openings and the at least one row of second profile support openings orthogonal to the framework support longitudinal direction substantially corresponds to the distance of first profile support openings directly following one another in the framework support longitudinal direction and/or the distance of second profile support openings directly following one another in the framework support longitudinal direction, or/and a plurality of successive pairs in the framework support longitudinal direction is formed with a respective first profile support opening and a second profile support opening, wherein in each pair of a first profile support opening and a second profile support opening the two profile support openings are substantially not offset relative to one another in the framework support longitudinal direction, wherein at least one framework support supporting element has a support head with a framework support supporting surface and a connecting web protruding from the framework support surface to be positioned between the two profile supports of a framework support with at least one connecting web opening for the passage of a connecting element, wherein at least one first connecting web opening and at least one second connecting web opening are provided in the connecting web, wherein a distance of the at least one first connecting web opening to a framework support supporting element longitudinal axis is smaller than a distance of the at least one second connecting web opening to the framework support supporting element longitudinal axis, and wherein two support structure elements, each to be coupled to a framework support or different framework supports by means of a framework support supporting element associated with them, have a support structure element distance from a plurality of predetermined support structure element distances from one another, and wherein support structure element distances of the plurality of support structure element distances, the distance of the at least one first connecting web opening to the framework support supporting element longitudinal axis, the distance of the at least one second connecting web opening to the framework support supporting element longitudinal axis and the distance of the profile support openings provided for coupling to the framework support supporting elements associated with the two support structure elements, directly following one another in the framework support longitudinal direction, of first profile support openings and second profile support openings of the framework support or of the different framework supports meet the following conditions:

$$A: \; D_{T1} = n_1 \times D_2 + 2 \times D_{16}$$

$$B: \; D_{T2} = n_2 \times D_2 - 2 \times D_{17}$$

$$C: \; D_{T3} = n_3 \times D_2 + D_{16} + D_{17}$$

wherein:

DT1, DT2, DT3 are support structure element distances from the plurality of support framework distances, n1, n2, n3 are integers, D2 is the distance of the profile support openings directly following one another in the framework support longitudinal direction of the profile support openings provided for coupling with the framework support supporting elements associated with the two support structure elements of first profile support openings and second profile support openings of the framework support or the various framework supports, D16 is the distance of the at least one first connecting web opening to the framework support supporting element longitudinal axis, D17 is the distance of the at least one second connecting web opening to the framework support supporting element longitudinal axis.

* * * * *